US007900426B2

(12) United States Patent
Stenbom

(10) Patent No.: US 7,900,426 B2
(45) Date of Patent: Mar. 8, 2011

(54) METHOD FOR PACKAGING FOOD PRODUCTS, AND AN ARRANGEMENT FOR USE IN SUCH A METHOD

(76) Inventor: Sverre Stenbom, Västra Frölunda (SE)

( * ) Notice: Subject to any disclaimer, the term of this patent is extended or adjusted under 35 U.S.C. 154(b) by 0 days.

(21) Appl. No.: 11/602,990

(22) Filed: Nov. 22, 2006

(65) Prior Publication Data

US 2007/0119125 A1 May 31, 2007

(30) Foreign Application Priority Data

Nov. 30, 2005 (EP) ..... 05111515

(51) Int. Cl.
*B65B 5/08* (2006.01)

(52) U.S. Cl. ..... 53/475; 53/473; 53/257; 53/260

(58) Field of Classification Search ..... 414/751.1, 414/753.1; 53/473, 475, 257, 258, 260
See application file for complete search history.

(56) References Cited

U.S. PATENT DOCUMENTS 3,685,717 A * 8/1972 Seiferth et al. ..... 220/23.8
3,778,965 A * 12/1973 O'Lenick et al. ..... 53/258
4,192,121 A * 3/1980 Caudle ..... 53/260
4,478,024 A * 10/1984 Vedvik et al. ..... 53/260
4,503,798 A * 3/1985 Hergeth ..... 414/751.1
5,018,338 A * 5/1991 Jurchuk et al. ..... 53/260
5,398,479 A 3/1995 Diete et al.
6,139,253 A * 10/2000 Battrel ..... 414/753.1

* cited by examiner

*Primary Examiner* — Christopher Harmon
(74) *Attorney, Agent, or Firm* — Harness, Dickey & Pierce, P.L.C.

(57) ABSTRACT

A method for packaging of food products, in which at least two products are to be packaged at the same portion carrier is disclosed. The method may include:

raising the food product to be moved to a portion carrier by a gripping device;

moving the food product to the selected portion carrier, and releasing the food product to the portion carrier.

The releasing of the food product may include:

positioning the gripping device at a predetermined level in relation to the portion carrier; and setting the gripping device to a first open position, whereby the gripping device defines a space for the food product to be placed in.

11 Claims, 5 Drawing Sheets

METHOD FOR PACKAGING FOOD PRODUCTS, AND AN ARRANGEMENT FOR USE IN SUCH A METHOD

PRIORITY STATEMENT

This application claims benefit of priority under 35 U.S.C. §119 from European Patent Application No. EP 05111515.2 filed on Nov. 30, 2005, in the European Patent Office, the disclosure of which is incorporated herein by reference in its entirety.

TECHNICAL FIELD OF THE INVENTION

The present invention relates to a method for packaging of food products, in which at least two products are to be packaged at the same portion carrier.

Further, the invention relates to gripping means to be utilized in such a method.

BACKGROUND ART

When packaging soft food products, such as fresh chicken, fish and other meat products, in portion carriers, it is important to obtain a well-packed portion carrier with a pleasant visual appearance. Packaging of such products may occur manually, i.e. sorters standing along a conveyor package them manually. However, it is also important that the packaging process is fast and efficient. Therefore, automatized arrangements for packaging of soft food products have been developed, in which arrangements the food may be delivered to suitable portion carriers by means of packaging robots. Such packaging robots usually include a claw, which holds the food product during transportation to the portion carrier. When the claw is positioned above the portion carrier into which the food product shall be delivered, the claw is opened and the food product falls down into the portion carrier.

With these known automatized methods and devices it is difficult to control the positioning of the food product in the portion carrier. Hence, the space in the portion carrier may not be efficiently utilized. This may lead to several disadvantages such as need for more storage room in production facilities and in stores, and higher transportation costs per weight unit of food. Another disadvantage is that the food in the portion carriers might be positioned such that the visual appearance of the product is unattractive for a potential buyer. Furthermore, it is not possible to influence the shape of the food product with these known automatized methods and devices without cutting the food product. Cutting of the food product is undesirable for at least two reasons, firstly, the customers most often want to obtain "whole" products and secondly, cutting requires another process step, which adds complexity to the process and potentially gives increased costs.

SUMMARY OF THE INVENTION

One object of example embodiments is to solve the issues mentioned above by providing an improved method for packaging of food products, and a portioning device.

According to example embodiments, a method for packaging of food products, in which at least two products are to be packaged at a same portion carrier is presented. The method may include:

raising the food product to be moved to a portion carrier by a gripping device; and moving the food product to the selected portion carrier, and releasing the food product to the portion carrier.

The releasing of the food product may include the steps of:

positioning the gripping device at a predetermined level in relation to the portion carrier; and setting the gripping device to a first open position, whereby the gripping device defines a space for the food product to be placed in.

Example embodiments, thus, are used to package food products in a controlled manner, i.e., lifting, transporting, and positioning the food products at a portion carrier. Since the food products are moved from the gripping device to a space defined by the gripping device, the position and shape of the food products may be controlled during the operation. Hence, the method may result in a closely packed portion carrier with an attractive visual appearance.

Suitably, the step of positioning said gripping means in relation to said portion carrier includes positioning said gripping means such that at least parts of said gripping means are at a level below the top surface of at least one first food product which have already been placed at said portion carrier.

If at least a first food product has been positioned at the portion carrier, it may be beneficial to position the gripping means such that at least the lower portions of the gripping means are positioned below the top portion of the at least one first food product before moving the food product from the gripping means to the portion carrier. This lowers the risk of undesirably positioning a food product at least partially on top of another food product. Hence, this positioning of the gripping means gives a better control of the packaging process.

Preferably, said gripping means includes ejector means, which ejector means are actuated when said space has been defined, said ejector means applying pressure on said food product in order to move said food product from said gripping means into said defined space at said portion carrier. Alternatively, said gripping means includes ejector means, which ejector means are actuated when said gripping means has been positioned at said predetermined level in relation to said portion carrier, said ejector means applying pressure on said food product in order to move said food product from said gripping means into said defined space at said portion carrier, wherein said movement of said food product sets said gripping means to said first open position.

In a situation where the food product to be packaged undesirably adheres to the gripping means it may be beneficial to utilize ejector means which are arranged to overcome the adhering force, thus releasing the food product from the gripping means. Furthermore, by utilizing ejector means, the movement of the food product from the gripping means to the portion carrier may be better controlled. The ejector means may be operated when the space at the portion carrier has been defined by the gripping means. Alternatively, the ejector means may apply pressure on the food product, such that the food product applies pressure on the gripping means. When the food product applies pressure on the gripping means, the gripping means may define the space at the portion carrier. When utilizing ejector means, the food product will be even more controlled in its movement from the gripping means to the portion carrier. Hence, the pressure of the ejector means increases the control of the positioning of the food product.

Alternatively, said gripping means may be positioned at a predetermined level in relation to said portion carrier such that the distance between the lower portion of the gripping means, when positioned in a holding condition, and the portion carrier is larger than the height of said food product. When said gripping means are positioned at said predetermined level, said ejector means applies pressure on said food product and maneuvers said food product into a position at said portion carrier. Said maneuvering of said ejector means includes that said ejector means becomes positioned such that the distance between said portion carrier and said ejector means is approximately equal to the height of said food product. Thereby, by this movement, said ejector means defines a space at said portion carrier for said food product to be placed in.

Preferably, said ejector means applies pressure on said food product concurrently as the gripping means are moved away from the predetermined level in relation to said portion carrier. This lowers the possibility that the food product alters its position or shape as the gripping means are moved away from the portion carrier.

Preferably, said gripping means are positioned adjacent at least one first food product at said portion carrier when packing a second food product at the same portion carrier, wherein said gripping means, when defining said space for said second food product, makes contact with the at least one first food product, and alters the shape and/or the position of said at least one first food product in order to define said space for said second food product. By this step, the food products may be packed even closer together, if desired.

Suitably, if for example the food products have an irregular shape, i.e. in the form of a truncated cone, the food products are being positioned head to tail at said portion carrier. By positioning the food products head to tail, the space at the portion carrier may be more efficiently utilized.

Preferably, said gripping means are arranged in a second open position before gripping said food product, wherein said gripping means defines a larger opening when positioned in said second open position compared to said first open position. By positioning the gripping means with a wider or larger opening when picking up the food products than releasing them, the risk of damaging or deforming the food products during pick up is lowered.

It may be suitable that air nozzle means provides an air stream directed towards the food product to be placed in said defined space at said portion carrier, in order to shape the food product to a desired shape when said food product is transferred from said gripping means to said portion carrier.

It is an object of the present invention to create a portion carrier with closely packed food products and with a nice visual appearance, without cutting the food products. Since the natural shape of food products may vary, it may be useful to be able to control the shaping even further than with the space defined by the gripping means. End portions of the food product positioned, i.e. hanging, outside the gripping means may then be shaped with air nozzle means such that the food product as a whole is desirably positioned and shaped at the portion carrier. Suitably, the food products to be shaped with the air nozzle are soft food products.

Preferably, said food product, when held by said gripping means, is in contact with a flexible part at said ejector means. The flexible part at the ejector means may fulfill the purpose of not leaving any marks from the ejector means on the food product. Hence, a nice visual appearance of the food product may be achieved. Furthermore, the flexible part may have a non-sticking surface, hence reducing the possibility of food products undesirably adhering to the ejector means.

Preferably, said food product is shaped to a desired shape when positioned in said portion carrier, wherein said shaping of said food product is at least partly effected by said ejector means in combination with said gripping means, wherein said ejector means has a concave shape in order to obtain the desired shape of said food product.

The gripping means may for example be adapted to hold a chicken fillet or tenderloin and form it to a relatively thin and high shape when positioned at said portion carrier.

The present invention also provides gripping means for use in a method as described above, which gripping means comprises first and second jaws, wherein said first and second jaws each have an outer side and a gripping side, said gripping sides of said first and second jaws facing each other, wherein said first and second jaws are articulately arranged in order to be movable between at least two relative positions, one holding position and one first open position, wherein said gripping means further comprises ejector means, which ejector means are arranged intermediate said gripping sides of said first and second jaws, wherein said ejector means are movable between a first retracted holding position and a second ejected position.

An arrangement like this may be suitable for carrying out the inventive method of close packaging of food products at a portion carrier.

Preferably, said jaws and said ejector means are movable between their respective different positions independently of each other. It is advantageous if the jaws and the ejector means are movable independently in relation to each other, when attempting to move a food product from the gripping means to a portion carrier. It may also be advantageously if the first and second jaws are movable between different positions independently of each other. For example may it sometimes be desirable to alter the jaws from a holding position to a first open position, and vice versa, by only altering the position of one of said first and second jaws.

Preferably, said jaws are designed as blades. With the jaws designed as blades, which are relatively thin, the outer sides of the jaws do not create or define unnecessary space in the portion carrier for the food product that is to be delivered. Instead, the shape and size of the space that the blades define in the portion carrier is the shape and size the food product will have once placed in or at the portion carrier. Unnecessary space created at the portion carrier might even be a disadvantage in order to obtain a close-packed portion carrier. Furthermore, with thin blades as jaws, the risk of damaging products already placed at the portion carrier is lowered.

In one embodiment of the present invention said first and second jaws of said gripping means further comprises foldable teeth in order to assist in the gripping of said food product. These foldable teeth may be arranged such that they assist in the lifting of a food product, and thereafter assists in holding the food product in said-gripping means. Alternatively, said teeth assists in the gripping of said food product, but does not assist in holding said food product in said gripping means. When said food product is to be transferred from said gripping means to, for example, a portion carrier, said teeth may be folded to another position, in which they do not obstruct the movement of the food product. By this, the food products may be easily picked up by the gripping means, safely held in the gripping means, and the risk of damaging the food product when it is intended to leave the gripping means is lowered.

Preferably, said gripping means are operable connected to air nozzle means. It may be desirable that a food product does not exceed a predetermined length at the portion carrier. By providing air nozzle means, air can be directed towards the food product and shape or bend an end portion of the food product towards the main body of the food product. Hence, the bent food product may be given the desired length at the portion carrier without being cut. Said air nozzle means are preferably arranged at, or adjacent, said gripping means in order to shape a food product held by said gripping means.

Suitably, said ejector means has a concave shape. A concave shape on the ejector means assists in shaping the food product to a desired shape if, for example, the food product is a soft chicken fillet or tenderloin.

It may be suitable that the part of said ejector means that is arranged to be in contact with said food product comprises recesses or cutouts on its contact surface. Alternatively, the part of said ejector means that is arranged to be in contact with said food product comprises or is produced of a grid. This non-solid surface, of either recesses or net, lowers the possibility of adherence between the ejector means and a food product. Optionally, the gripping side of one or both of the jaws may also comprise recesses or a meshed net in order to lower the possibility of adherence between the jaws and a food product.

It may be advantageous if said ejector means further comprises a flexible part. A soft or flexible part at the ejector means lowers the possibility for the ejector means to leave any undesired marks on the food products and helps in obtaining an attractive visual appearance of the product packaged in the portion carrier. In one embodiment a thin rubber membrane constitutes the soft flexible part at the ejector means.

Furthermore, the flexible part or rubber membrane may be inflatable, in order to assist in applying pressure on said food product when said food product is transferred from said gripping means to said defined space at said portion carrier. With an inflatable rubber membrane it is possible to apply pressure on the food product even when the ejector means are moving away from the portion carrier. This means that the gripping means may move away from the portion carrier before the food. product is fully positioned at a portion carrier, and the ejector means still applies pressure on the food product. This gives better control over the placement of the food product in the portion carrier and helps in increasing the packaging speed.

Suitably, said ejector means is coated with a non-stick material, at least on the side and/or part of said ejector means which said food-product may come into contact with during normal operation of said gripping means. In order to lower the possibility of food products adhering to the ejector means, it may be preferred to coat the ejector means with a non-stick material. If food products adhere to any part of the gripping means, the product may be damaged. Furthermore, in such an event the process may be slowed down. Alternatively, said ejector means may be produced of a non-stick material, in order to lower the risk of food products adhering to the ejector means.

Preferably, said jaws of said gripping means are each articulately arranged around a respective axle, wherein each of said axles have a longitudinal extension, and wherein said axles extend at an angle in relation to each other. Arranging said jaws at non-parallel axles gives as a result that said jaws becomes positioned nonparallel in relation to each other, i.e. the distance between the jaws at one end of the arrangement is greater than the distance-at the other end of the arrangement. This may be suitable in order to fit the shape of certain types of food products, e.g. if the food products have a shape similar to a truncated cone. An arrangement that fits the shape and size of the food product that is to be lifted and transported with the gripping means is preferred. The gripping device is intended for use in an apparatus that packages food products with high speed, and it is preferred that the food products are securely held in place during the operation. The fitting of the shape is preferably three-dimensional, i.e. both lengthwise and transverse.

Another advantage with a shape that are adapted to the specific food product is that the food product is better fixated in the gripping means, i.e. the risk that the food product may turn or twist during the operation is lowered. If the food product is placed with the desired side facing upwards at the pick-up area, then the desired side will face upwards at the portion carrier as well, i.e. with the intended side of the food product facing a potential buyer. This gives a controllable way to achieve the objectives of the present invention.

It is preferred that said gripping means are operable between at least three positions, one holding position and two open positions wherein said gripping means defines a larger space when positioned in a second open position compared to a first open position. The possibility to have a larger gap at the gripping means when lifting products than releasing them is favorable in terms of avoiding damage on the food product that is to be lifted. Furthermore, a narrow gap when releasing food products helps in shaping the food products to a desired shape at the portion carrier, a shaping which is neither useful nor wanted when lifting the food products.

BRIEF DESCRIPTION OF THE DRAWINGS

The invention will be described in more detail in the following with reference to the accompanying schematic drawings, which for the purpose of exemplification illustrate embodiments of the invention.

DETAILED DESCRIPTION OF PREFERRED EMBODIMENTS OF THE INVENTION

Figure 1A:
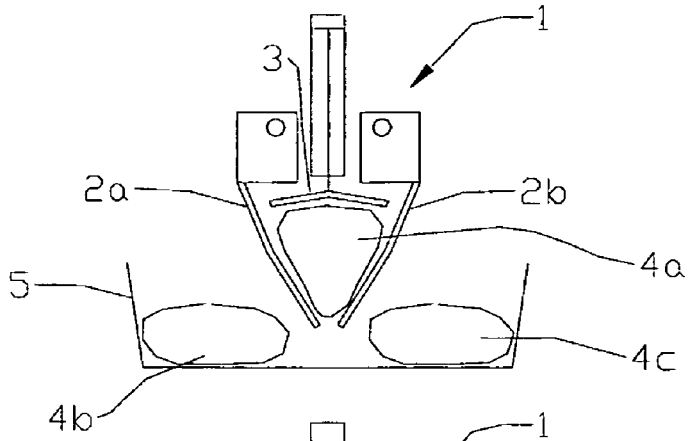
FIG. 1*a*-1*d* are side views, in sequence, showing a method for packaging-food products in a portion carrier according to the invention.

The portioning device of the present invention comprises positioning means (not shown) and gripping means 1 which includes first and second articulately arranged jaws 2*a*,2*b* and concave ejector means 3. The first and second jaws 2*a*,2*b* are designed, as can be seen in for example FIGS. 1*a*, 3*b* and 5*b*, so as to form a hull like structure, wherein more space is provided at the upper portion of the gripping means compared to the lower portion. The ejector means are movable in an, at the drawings, upward-downward manner between the upper portion of the jaws 2*a*,2*b* and the lower portions of the jaws 2*a*,2*b*. The ejector means may be movable between their alternative positions by means of for example electrical or pneumatic power.

In use the gripping means 1 lifts a food product 4*a*from a pick-up area such as, for example, a moving or still standing conveyor belt (not shown) feeding food products 4 into the arrangement, and positions the lifted food product 4 at or in a portion carrier 5. Preferably, the position and orientation of the food products in the system are known, e.g. by sensor means. The jaws 2*a*,2*b* of the gripping means 1 closes around a food product 4 at the pick-up area and forces the food product 4 upwards in the gripping means 1. The shape and size of the gripping means 1 and ejector means 3 are preferably chosen such that the gripping means 1 holds the food product 4 so that the food product 4 at least partly makes contact with the jaws 2*a*,2*b* and the ejector means 3.

In FIG. 1*a* the gripping means 1 holds a food product 4*a* and two other food products 4*b*,4*c* have already been placed at the portion carrier 5. The gripping means 1 has moved from the conveyor belt (not shown) where it collected the food product 4 and is positioned somewhat over the two food products 4*b*,4*c* at the portion carrier 5.

Figure 1B:
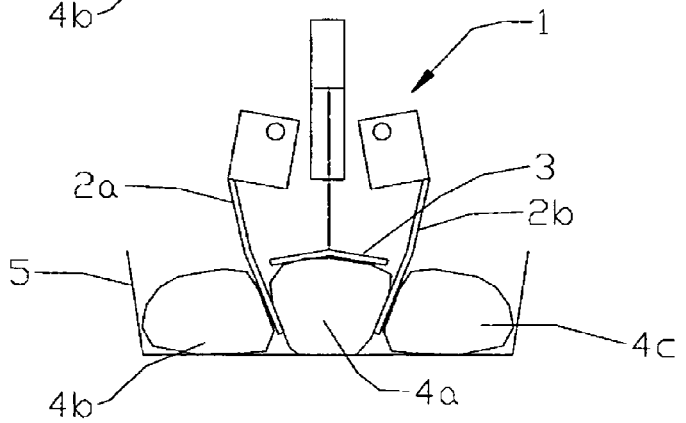

In FIG. 1*b* the gripping means 1 has been lowered into a predetermined level in relation to the portion carrier 5. The jaws 2*a*,2*b* of the gripping means 1 are in a position where at least the lower portions of the jaws 2*a*,2*b* are below the top surface of the food products 4*b*,4*c*, which are already placed at the portion carrier 5. The jaws 2*a*,2*b* may here come into contact with the food products 4*b*,4*c* and slightly deform or move the food products 4*b*,4*c* towards the edge of the portion carrier 5. When the lower portion of the gripping means 1 is positioned somewhat below the top surface of the food products 4*b*,4*c* the gripping means 1 moves from the holding position to a first open position and the ejector means 3 are actuated. When the first and second jaws 2*a*,2*b* moves from a holding position to an open position, each jaw 2*a*, 2*b* pivot around a respective axle. The first open position of the gripping means 1 defines an opening that is large enough for the food product 4*a* to pass through. However, the opening is small enough to shape the food product to a desired shape, as it passes through the opening. As the jaws 2*a*,2*b* are moved to the first open position they may further deform or move the food products 4*b*,4*c*, respectively, against or towards a side wall of the portion carrier 5. Thereby space is defined for the food product 4*a* in the portion carrier. The ejector means 3, when actuated, applies pressure on the food product 4, which assists in moving the food product 4*a* out of the gripping means 1 and into the defined space of the portion carrier 5. The jaws 2*a*,2*b* may for example be operated by means of electrical or pneumatic power.

The blades or jaws 2*a*,2*b* are preferably produced of relatively thin material so that they can at least partly pass down below the top portion of already existing food products 4*b*,4*c* in the portion-carrier 5, without damaging the food products 4*b*,4*c*.

Figure 1C:
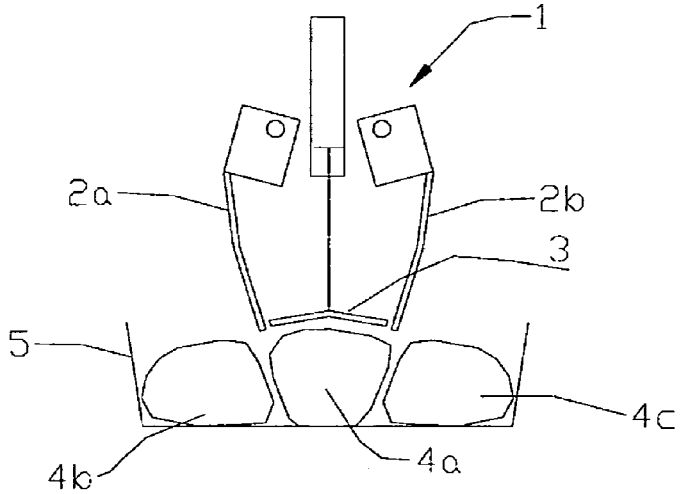

As can be seen in FIG. 1*c* the gripping means are thereafter raised and lifted out of the portion carrier, while the ejector means still applies pressure on the food product 4*a*, which leaves the food product 4*a* in the desired place and position at the portion carrier 5. Thereafter, the ejector means 3 are raised, leaving the product 4*a* in the portion carrier 5.

With the process of packaging food products as described above, the food product may be in contact with at least one part of the jaws 2*a*,2*b* or the ejector means 3 during the whole operation. Therefore, the food product 4 is placed at the portion carrier 5 in a controlled manner, and does not fall from the gripping means 1 onto the portion carrier 5.

Figure 1D:
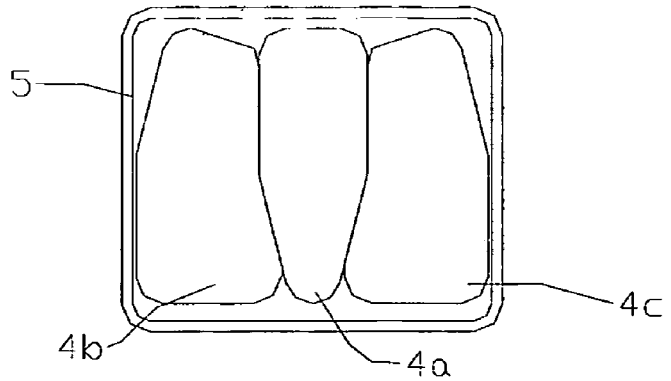

FIG. 1*d* is a top view of a packed portion carrier 5 comprising three food products 4*a*,4*b*,4*c*. As can be seen the food products lie head to tail in order to obtain a close packing of the food products. This head to tail packing can for example be useful when the food products have a natural shape like a truncated cone, where one side is thinner and/or narrower than the other side, as for example is the case with chicken fillets or drumsticks.

The food products 4 do not rotate or turn during any step of this packing operation. This means that if the food products are positioned with a desired side of the product facing upwards at the pick-up area, the same side will face upwards when the food product has been placed in or at a portion carrier 5, resulting in control over the visual appearance of the portion carrier 5 and its contained products.

Figure 2A:
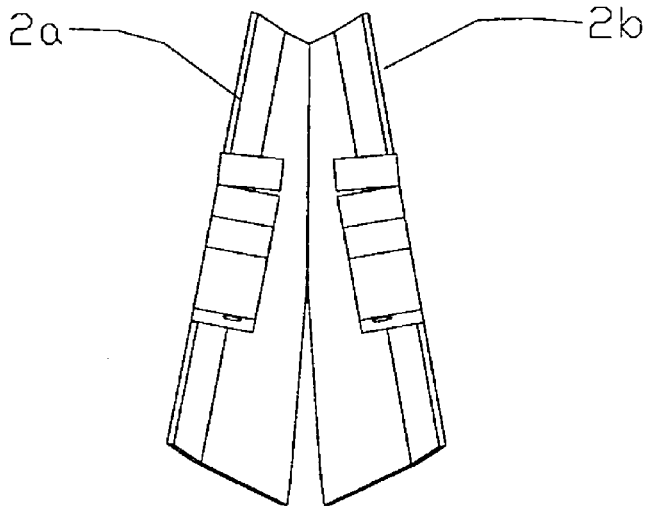
FIG. 2*a*-2*c* are schematic top views of parts of the gripping means according to the invention.
Figure 2B:
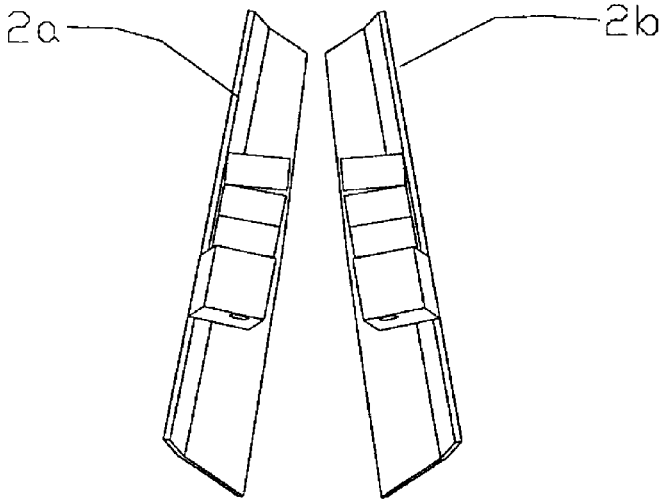
Figure 2C:
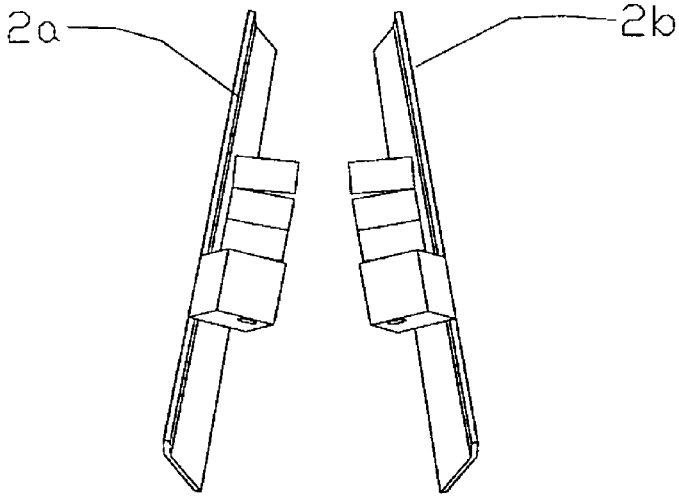

FIG. 2*a* to 2*c* shows the two jaws or blades 2*a*,2*b* from a top perspective. Each of the jaws 2*a*,2*b* are, independent of each other, articulately arranged around a respective axle. As can be seen from FIGS. 2*a* to 2*c*, the axles are arranged non-parallel. In FIG. 2*a* the jaws 2*a*,2*b* are in a holding position for a food product (not shown). In this embodiment the blades 2*a*,2*b* are adapted to fit the shape of a chicken fillet, wherein the distance between the jaws 2*a*,2*b* are larger at one end in relation to the other end, i.e. one end of the gripping means 1 have more space than the other end. Other configurations of the jaws 2*a*,2*b* are also possible and they can be configured with respect to the shape of the food product to be held.

FIG. 2*b* shows the jaws 2*a*,2*b* in a condition where a food product is to be transferred from the gripping means 1 to a portion carrier 5. The jaws 2*a*,2*b* are in a first open position and a food product can pass between the jaws 2*a*,2*b* to a portion carrier 5.

FIG. 2*c* shows the jaws 2*a*,2*b* in a second open position. In this second open position the gap or distance between the two jaws 2*a*,2*b* are larger than between the jaws 2*a*, 2*b* in the first open position. The second open position is for use when a food product 4 is to be enclosed in the gripping means when picked up from for example a conveyor belt. The larger gap results in that the food products 4 can be enclosed in the gripping means 1 without being damaged or deformed during the enclosing stage.

The width of the gaps of both the first and the second open position are dependable on the actual size, shape and type of food product that are to be packaged. The width of the gaps can also be adjusted depending on the preferred shape of the packed food product 4. If a high and thin product is desired, the gap of the first open position is made relative small in relation to the natural shape of the food product 4 and the product is pressed out by the ejector means 3 through the gap.

FIGS. 3*a* to 3*d* shows a sequence of packing a food product 4 according to a second embodiment of the invention. In this embodiment the ejector means 3 are provided with a flexible rubber membrane 6 as can be seen from FIG. 3*a*. Like features as in the previous embodiments have been given like numerals, and sequence steps similar to the ones of the previous embodiment are not described specifically for this embodiment.

Figure 3A:
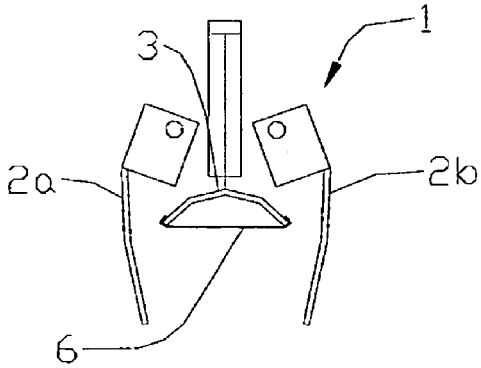
FIG. 3*a*-3*d* are sequential side views of gripping means in use for packing a food product according to a second embodiment of the invention.
Figure 3B:
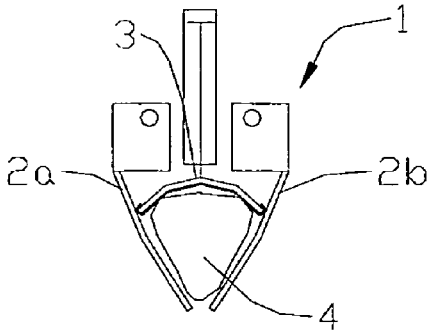

In FIG. 3*b* a food product 4 is held by the gripping means 1 and the food product bear against the jaws 2*a*, 2*b* and the rubber membrane 6 of the ejector means 3. Hence, the rubber membrane bends to fit the shape of the food product 4 and the ejector means 3.

Figure 3C:
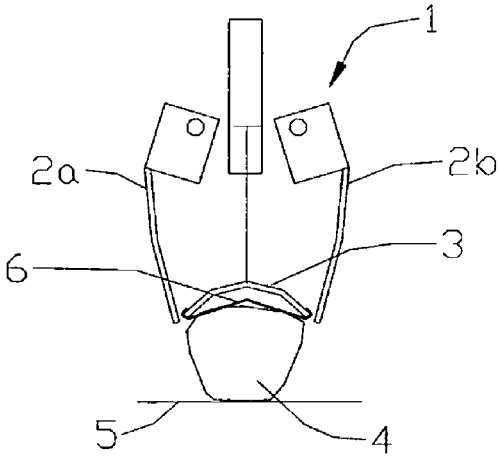

In FIG. 3*c* the gripping means are in their first open position and the food product 4 is passed from the gripping means 1 to for example a portion carrier 5 (shown partially in FIG. 3*c*) by means of pressure applied on the food product by the ejector means 3.

Figure 3D:
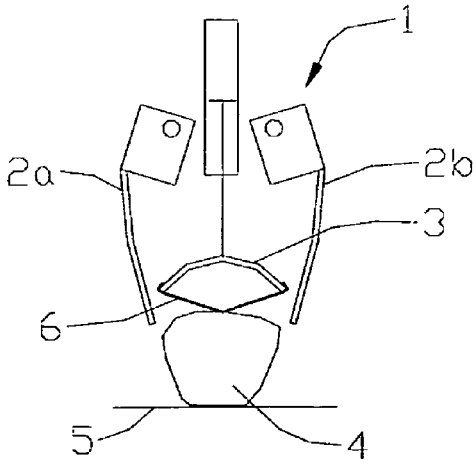

In FIG. 3*d* it can be seen that the flexible rubber membrane 6 is in an inflated condition. This inflating of the flexible rubber membrane may be provided for example by means of pressurized air (not shown). Hence, the rubber membrane 6 applies pressure on the food product 4 even while the gripping means and/or ejector means are being raised from the food product.

Figure 4:
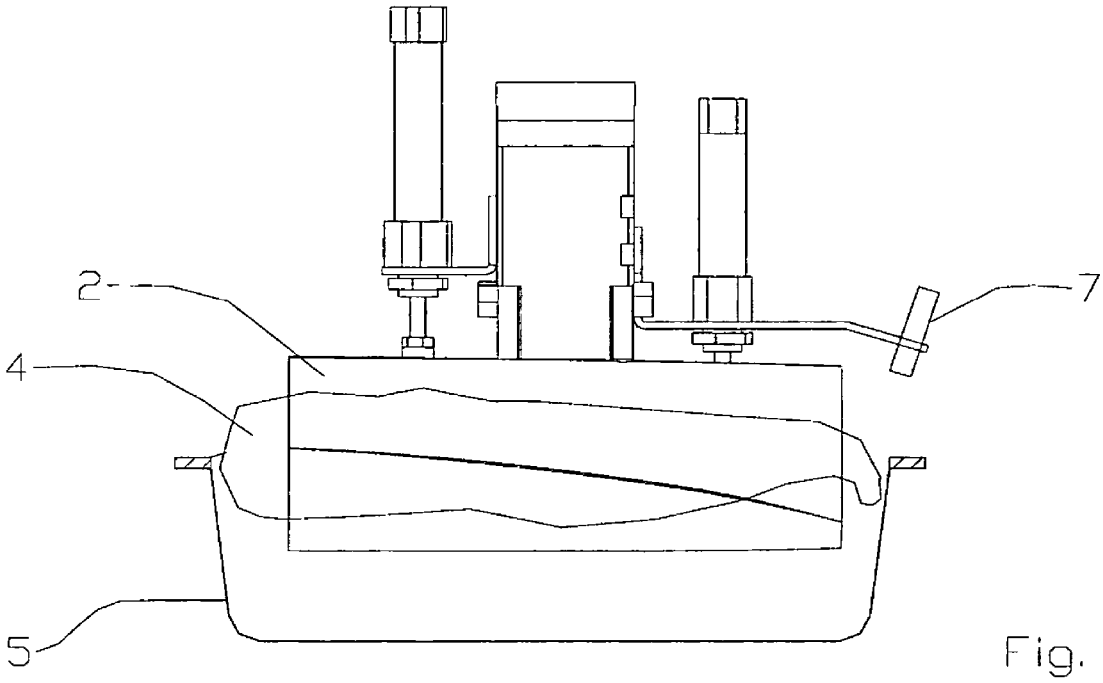
FIG. 4 are a schematic side view of a portioning device comprising air nozzle means according to the invention.

The portioning device and the method according to both of the previously described embodiments of the invention may also be provided with air nozzle means 7. As can be seen from FIG. 4 the air nozzle means are preferably arranged such that they can direct an air stream towards a desired portion of the food product 4 in order to assist in shaping the food product 4 into a desired shape, before the food product is positioned at the portion carrier 5. The food product 4 is preferably soft so that the air directed towards it can bend for example a thin portion or tail of it, in order to obtain a more closed-packed product with an attractive visual appearance.

The air nozzle means 7 can for example be a spray nozzle, which may be controlled for example by an electronic valve.

Figure 5A:
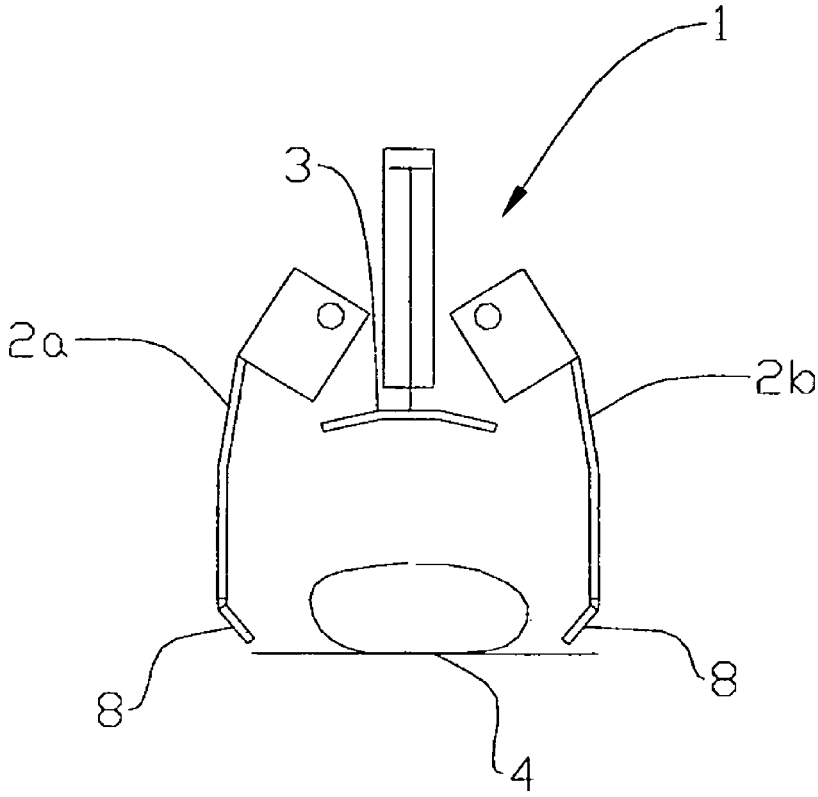
FIG. 5*a*-5*b* are schematic side views of gripping means according to a third embodiment of the invention.
Figure 5B:
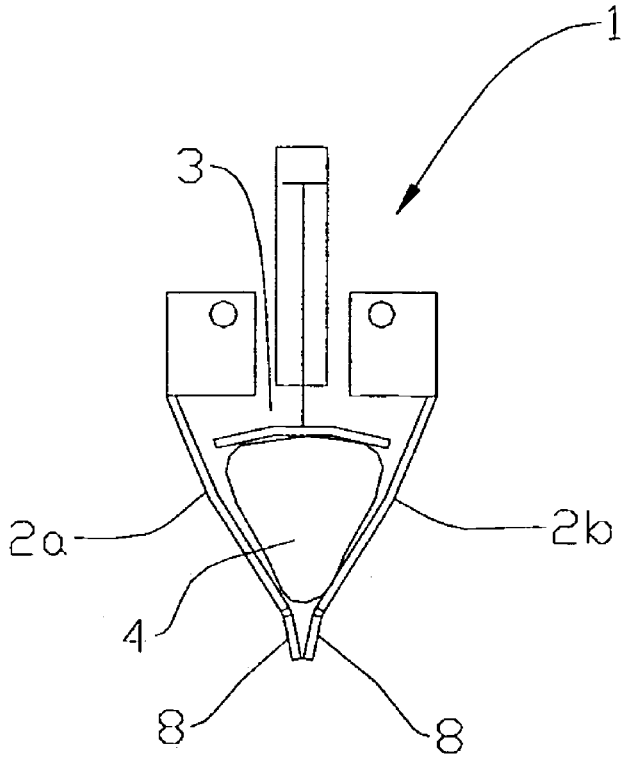

FIGS. 5*a* and 5*b* show another embodiment of the present invention, intended to be used in a manner similar to what has been described above for the previous embodiments. Also in this embodiment have like features been given like reference numerals. Likewise will features and process steps, which functions in the same manner as for the previous embodiments, not be elaborated upon herein. The jaws 2*a*,2*b* are in this embodiment provided with foldable or pivotable teeth 8 on their respective lower portions. In FIG. 5*a*, the foldable teeth 8 are positioned such that they extend at an angle from the respective jaw 2*a*,2*b*, pointing towards the space between the jaws 2*a*,2*b*. From this first position the foldable teeth 8 are foldable downwardly to the position shown in FIG. 5*b*.

In use, when picking up a food product, the teeth 8 are positioned at an angle in relation to the jaws 2*a*, 2*b* in order to assist in the lifting of the food product 4 from for example a conveyor belt. The pick-up area, e.g. a conveyor belt, may be provided with recesses (not shown) of corresponding shape to the teeth 8. The food product may then, at the pick-up area, be positioned over or between such recesses, such that the teeth of the jaws may be positioned to be guided into these recesses, whereby the teeth becomes positioned beneath the food product, which even further aids in the lifting of the food products 4 from e.g. a conveyor belt.

When a food product 4 is held by the gripping means 2*a*,2*b* or when a food products is intended to be carried away from the gripping means 1 the teeth are folded downwardly to a position as shown in FIG. 5*b*. With the teeth 8 in the position shown in FIG. 5*b*, the teeth does not obstruct or hinder the transport of the food product 4 out of the gripping means, or damage the food product 4 as it is carried out of the gripping means 1.

In this embodiment, the teeth have only been illustrated in two different positions. However, the teeth may be movable between several different positions in order. to assist in the inventive method of gripping food products.

The maneuvering of the teeth between their different positions may for example be provided for by means of electrical or pneumatic power.

The positioning means (not shown) and moving means (not shown) which may be necessary for all of the above-described embodiments in order to in an automatized manner move the gripping means from a pick-up area to an area with at least one portion carrier 5, and to position the gripping means correctly in relation to a portion carrier 5, are well known in the art and will not be further elaborated upon herein.

The present invention is suitable for use in an automatized or robotized method and arrangement for packaging of food products. However, it may also be utilized in other food packaging arrangements, such as semiautomatized or manual packaging arrangements and operations. A method and an automatized device for packaging of food in which the present invention is suitable is for example disclosed in international application WO 2005 106 405.

It will be appreciated that many modifications of the above-described embodiments of the invention are possible within the scope of the invention as defined by the appended claims.

The inventive concept has in the description above and in FIGS. 1*a*-1*d* been illustrated with three food products 4*a*,4*b*, 4*c* that are to be packaged at a portion carrier 5. However, the inventive methods and devices is not limited to that numeral and is suitable for any number of food products that are to be packaged at the same portion carrier. Furthermore, the number of food products to be packaged at the same portion carrier does not need to be known beforehand the operation starts.

The invention is especially useful for packaging soft food products, by which is understood to mean all types of foods which are not frozen. For example, but not limited to, is the inventive concept useful for packaging of parts of poultry such as fillets, legs, breasts, and packaging of parts of beef or pork such as pieces of meat, fillets and tenderloin. However, the inventive concept can also handle food products that are not soft or food products that contains both soft and hard parts, e.g. parts of poultry, beef and pork with bone.

The gripping side of jaws 2*a*,2*b* and the part of the ejector means 3 facing the food product may be adapted in various shapes, sizes, forms and materials. Furthermore, it may be adapted with different patterns in order to obtain an attractive pattern on the food product. The ejector means 3 may for example be designed in one piece, in one piece with recesses or as a meshed net or a lattice. Further, the ejector means and/or the jaws may also be coated with, or produced of, a non-stick material in order to lower possible undesired adherence of the food product to any part of the gripping means.

Furthermore, in order to reduce the weight of the movable parts, and thereby facilitate for a higher operation speed of the device, the jaws 2*a*, 2*b* and/or the ejector means 3, and/or the foldable teeth 8 may be produced of or comprise a lightweight material. Such a material may for example be carbon fiber.

The jaws 2*a*,2*b* may have an angled lower portion. This lower angled portion assists in packing the food products in the portion carrier more closely together.

It should be apparent for someone skilled in the art that combinations of features of the different embodiments described above are not only possible, but may also be preferable, depending on the actual type of food product that is to be packaged.

The invention claimed is:

1. A method for packaging of food products, in which the food products are to be packaged in a same portion carrier, comprising:

raising at least one first food product to be moved to a portion carrier by a gripping device;

moving said at least one first food product to the selected portion carrier; and releasing said at least one first food product to the portion carrier;

wherein said releasing of said at least one first food product includes:

positioning said gripping device at a predetermined level in relation to said portion carrier; and setting said gripping device to a first open position, whereby said gripping device defines a space for the at least one first food product to be placed in and releases the at least one first food product, setting the gripping device to a second open position and gripping a second food product from a pick up area, wherein the second food product is moved to said selected portion carrier to a desired positioning thereof; and setting said gripping device to said first open position, whereby said gripping device defines a second space for said second food product to be placed in said portion carrier;

positioning said gripping device adjacent at least one first food product at said portion carrier when packing the second food product at the same portion carrier, and said gripping device, when defining said second space for said second food product, alters a shape and/or a position of said at least one first food product in order to define said second space for said second food product; and releasing the second food product.

2. The method as claimed in claim 1, wherein said gripping device includes an ejector device, in which said ejector device is actuated when said first and second spaces have been defined, said ejector device applying pressure on said at least one of the first and second food products in order to move said respective first and second food products from said gripping device into said respective defined space at said portion carrier, and said gripping device includes first and second jaws, articulately arranged in order to be movable between at least two relative positions, said jaws forming a hull like structure to force the at least one of the first and second food products upward in the gripping device.

3. The method as claimed in claim 1, wherein said gripping device includes an ejector device, in which said ejector device is actuated when said gripping device has been positioned at said predetermined level in relation to said portion carrier, said ejector device applying pressure on said at least one of the first and second food products in order to move said at least one of the first and second food products from said gripping device into said respective defined space at said portion carrier, and said movement of said at least one of the first and second food products sets said gripping device to said first open position.

4. The method as claimed in claim 2, wherein said ejector device applies pressure on said at least one of the first and second food products concurrently as the gripping device is moved away from the predetermined level in relation to said portion carrier.

5. The method as claimed in claim 1, wherein said at least one of the first and second food products are being positioned head to tail at said portion carrier.

6. The method as claimed in claim 1, further comprising arranging said gripping device in the second open position before gripping said at least one of the first and second food products, wherein said gripping device defines a larger opening when positioned in said second open position compared to said first open position.

7. The method as claimed in claim 1, wherein air nozzle device provides an air stream directed towards the at least one of the first and second food products to be placed in said respective defined space at said portion carrier, in order to shape the at least one of the first and second food products to a desired shape when said at least one of the first and second food products is transferred from said gripping device to said portion carrier.

8. The method as claimed in claim 2, wherein said at least one of the first and second food products, when held by said gripping device, is in contact with a flexible part at said ejector device.

9. The method as claimed in claim 2, wherein said at least one of the first and second food products is shaped to a desired shape when positioned in said portion carrier, wherein said shaping of said at least one of the first and second food products is at least partly effected by said ejector device in combination with said gripping device, and said ejector device has a concave shape in order to obtain the desired shape of said at least one of the first and second food products.

10. A method for packaging of food products, in which the food products are to be packaged at the same portion carrier, comprising:

raising at least one first food product to be moved to a portion carrier by a gripping device;

moving said at least one first food product to the selected portion carrier; and releasing the at least one first food product to the portion carrier, wherein said releasing of said at least one first food product includes:

positioning said gripping device at a predetermined level in relation to said portion carrier; and setting said gripping device to a first open position, whereby said gripping device defines a space for said at least one first food product to be placed in said portion carrier;

setting the gripping device to a second open position and gripping a second food product;

wherein the second food product is moved to said selected portion carrier to a desired positioning thereof;

setting said gripping device to said first open position, whereby said gripping device defines a second space for said second food product to be placed in said portion carrier; and positioning said gripping device adjacent at least one first food product at said portion carrier when packing the second food product at the same portion carrier, and said gripping device, when defining said second space for said second food product, alters a shape and/or a position of said at least one first food product in order to define said second space for said second food product, wherein said gripping device includes first and second jaws, articulately arranged in order to be movable between at least two relative positions, said jaws forming a hull like structure to force the at least one first food product upwards in the gripping device.

11. A method for packaging of food products, in which the food products are to be packaged in a same portion carrier, comprising:

raising at least one first food product to be moved to a portion carrier by a gripping device;

moving said at least one first food product to the selected portion carrier; and releasing said at least one first food product to the portion carrier;

wherein said releasing of said at least one first food product includes:

positioning said gripping device at a predetermined level in relation to said portion carrier; and setting said gripping device to a first open position, whereby said gripping device defines a first space for said at least one first food product to be placed in, setting the gripping device to a second open position and gripping a second food product, wherein the second food product is moved to said selected portion carrier to a desired positioning thereof, at a predetermined level in relation to said portion carrier;

positioning said gripping device adjacent the at least one first food product at said portion carrier when packing the second food product at the same portion carrier, and said gripping device, when defining a second space for said second food product, makes contact with the at least one first food product, and alters a shape and/or a position of said at least one first food product in order to define said second space for said second food product; and setting said gripping device to said first open position so that said second food product is placed in said portion carrier.

* * * * *